US006773071B1

(12) United States Patent
Stasney et al.

(10) Patent No.: US 6,773,071 B1
(45) Date of Patent: Aug. 10, 2004

(54) CHAIR HAVING OUTRIGGED LIMB RESTS FOR OUTSTRETCHED ARMS

(76) Inventors: T. Glen Stasney, 10752 Co. Rd. 8070, West Plains, MO (US) 65775; Jason K. Stasney, 2508 Co. Rd. 6560, Pottersville, MO (US) 65790

( * ) Notice: Subject to any disclaimer, the term of this patent is extended or adjusted under 35 U.S.C. 154(b) by 40 days.

(21) Appl. No.: 10/131,587

(22) Filed: Apr. 23, 2002

Related U.S. Application Data

(60) Provisional application No. 60/286,135, filed on Apr. 24, 2001.

(51) Int. Cl.[7] ..... A47C 7/54

(52) U.S. Cl. ..... 297/411.27; 297/411.1; 297/411.33; 297/411.36; 248/118.3

(58) Field of Search ..... 297/115, 411.35, 297/411.36, 411.1, 411.32, 411.38, 411.37, 411.2, 411.27, 411.26, 411.33; 248/118.3, 118.5, 286.1, 292.12

(56) References Cited

U.S. PATENT DOCUMENTS 4,069,995 A * 1/1978 Miller ..... 248/118.1
5,029,941 A * 7/1991 Twisselmann
5,074,501 A * 12/1991 Holtta ..... 248/118.3
5,143,422 A 9/1992 Althofer et al. ..... 297/411
5,369,805 A * 12/1994 Bergsten et al. ..... 297/411.35
5,571,274 A 11/1996 Holstensson ..... 297/411.38
5,655,814 A * 8/1997 Gibbs ..... 297/411.38
5,752,683 A * 5/1998 Novis et al. ..... 297/411.36 X
5,755,650 A 5/1998 Urso ..... 482/138
5,848,823 A * 12/1998 Su ..... 297/411.36
5,927,815 A 7/1999 Nakamura et al. ..... 297/411.38
D438,725 S * 3/2001 Takahashi ..... D6/418
6,619,747 B2 * 9/2003 Ko et al. ..... 297/423.12

* cited by examiner

*Primary Examiner*—Peter M. Cuomo
*Assistant Examiner*—Stephen Vu
(74) *Attorney, Agent, or Firm*—Jonathan A. Bay

(57) ABSTRACT

A chair is provided with an outrigged limb rest for supporting a user's substantially outstretched arm. The chair has a seat for supporting the user, an adjustable outrigger connected to the seat, and a limb rest carried on the adjustable outrigger for supporting the user's outstretched arm. The adjustable outrigger includes a mechanism for adjusting or varying the elevation of the limb rest between upper and lower extremes as well as varying the inboard to outboard position of the limb rest between inboard and outboard extremes such that the limb rest is positionable to afford a rest or landing place for the elbow, forearm, or both of the user's arm when substantially outstretched.

9 Claims, 2 Drawing Sheets

CHAIR HAVING OUTRIGGED LIMB RESTS FOR OUTSTRETCHED ARMS

CROSS-REFERENCE TO PROVISIONAL APPLICATION(S)

This application claims the benefit of U.S. Provisional Application No. 60/286,135, filed Apr. 24, 2001.

BACKGROUND AND SUMMARY OF THE INVENTION

The invention relates to chairs and more particularly to a chair having outrigged rests for outstretched arms.

Sonographers, among other parties that would benefit from the invention, are a group of professionals in the medical field characterized in part by having to assume and awkward, tiring posture to do the job. Briefly, sonographers, as a group perform any variety of medical examinations of patients typically with ultrasound equipment. An example scenario has the sonographer positioned between the patient (ie., the exam subject) and the user interface of the data-recording equipment. That is, right-handed sonographers might find it most comfortable to hold the ultrasound probe in the right hand while keying in keystrokes or the like with the left hand (or vice versa). Regardless which is the hand of choice to hold the probe, what typically happens is that the sonographer has his or her arms outstretched in a spread wing fashion during the course of the exam procedure. To refer momentarily ahead to the drawings, FIG. 1 gives an example of what this posture might appear like.

During most sonograms, the sonographer may be forced to hold the arms outstretched like that for between fifteen (15) to fifty (50) minutes. Needless to say there are problems with holding such a posture for that long several times a day for a career.

Indeed the incidence of musculoskeletal injuries among sonographers is as high as 85%. What is needed is an improvement which provides solutions to persons such as sonographers who work with their arms outstretched as mentioned. It is an object of the invention to provide a chair incorporating various enhancements which provide improvements for such persons.

It is another object of the invention to provide a chair having outrigger structures to provide a rest or landing place for the elbow, forearm, or both of a user's arm when substantially outstretched.

It is an additional object of the invention that the outrigger structures are adjustable between not only upper and lower extremes but more significantly between inboard and outboard extremes.

These and other aspects and objects are provided according to the invention in a chair having an outrigged limb rest for supporting a user's substantially outstretched arm. The chair has a seat for supporting the user, an adjustable outrigger connected to the seat, and a limb rest carried on the adjustable outrigger for supporting the user's outstretched arm The adjustable outrigger includes a mechanism for adjusting or varying the elevation of the limb rest between upper and lower extremes as well as varying the inboard to outboard position of the limb rest between inboard and outboard extremes such that the limb rest is positionable to afford a rest or landing place for the elbow, forearm, or both of the user's arm when substantially outstretched.

The chair can optionally include two such outrigged arm rests as well as a crutch or rest on one or both sides so that the user can lean or slump on and thereby relieve tension on muscles that hold upright seated posture over extended periods of time.

A number of additional features and objects will be apparent in connection with the following discussion of preferred embodiments and examples.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figure 1:
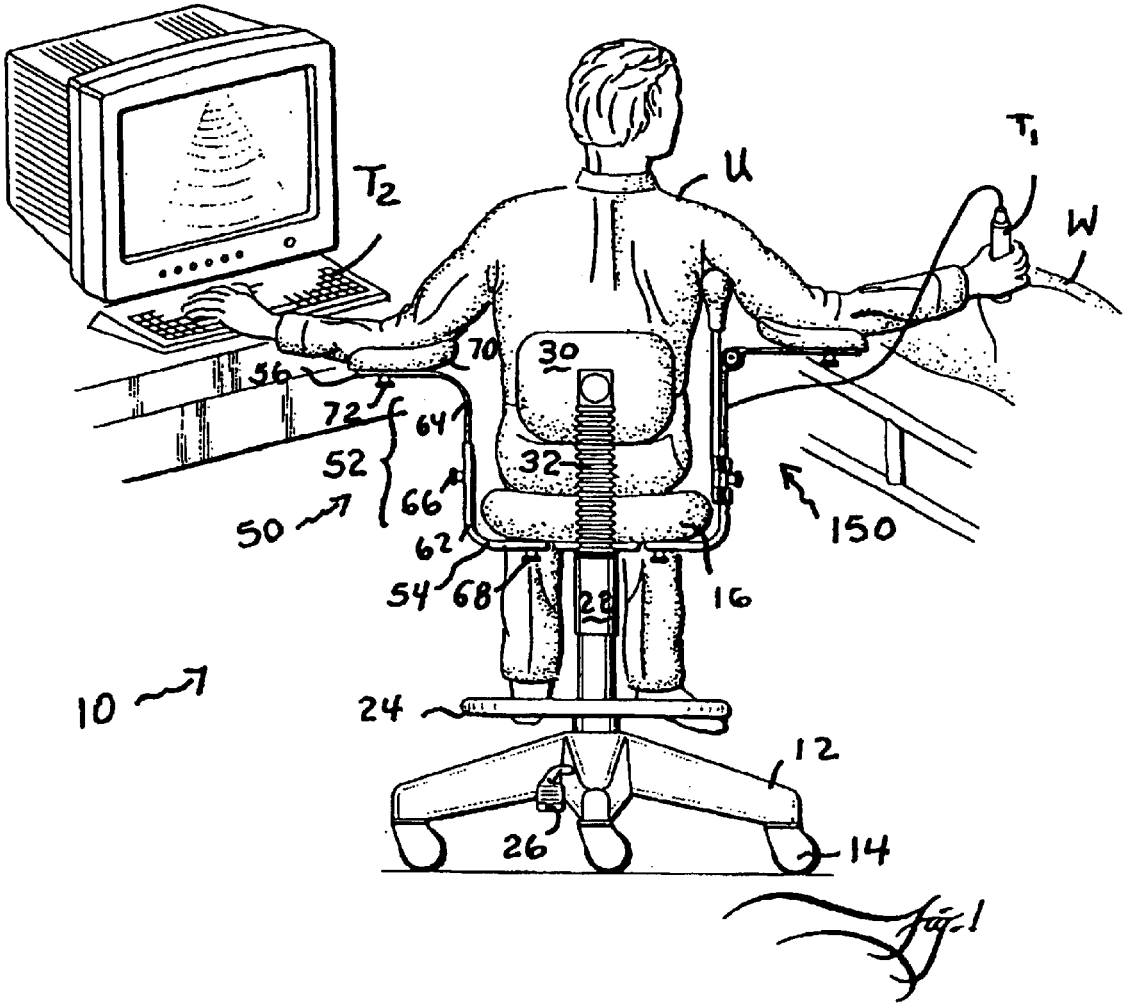
FIG. 1 is a perspective view of a chair having outrigged limb rests for outstretched arms in accordance with the invention.

FIG. 1 shows of a chair 10 having outrigged limb rests 50,150 for outstretched arms in accordance with the invention. One example use environment for a chair 10 having outrigged limb rests 50,150 for outstretched arms includes without limitation the field of sonography. As FIG. 1 shows, a sonographer (eg, user U) is seated in the inventive chair 10 and adopting a typical work posture, with outstretched arms, one hand holding a probe (or first tool $T_1$) in one hand and applying it to a patient (eg., workpiece W) as the opposite hand reaches over to a keyboard or other operative input, interface or controller device (eg., tool $T_2$) relating to controls, signal-conditioning or data-taking functions of the equipment. It is an aspect of the invention to provide support and various comforts to the user U whose work forces him or her to hold such position(s) as shown and thereby lessen fatigue, discomfort and aching.

General aspects of the chair 10 include a seat 16 preferably supported for swiveling as by a swivel stand 12 as shown in the drawings. The swivel stand 12 preferably includes wheels or rollers 14 with releasable locking or braking devices for parking the chair 10 in a relatively stationary position. An example preferred construction for the seat 16 has it produced with a rigid base covered over by a cushion such as fabric-encased open-cell foam or the like. The seat 16's rigid base is provided with various fixtures including mounting fixtures for adjustable slide elements as well as various fixtures for levers or actuators. These fixtures can be formed in any suitable manner including within the rigid base or hung underneath and so on.

For instance, preferably there are various levers or actuators (not in view) for adjusting the relative elevation of the seat 16 above the floor as is known in the art, including by a conventional way as having telescoping tubular members 22 (as shown) with pneumatic locking and releasing or the like. It is an aspect of the invention that the chair 10 include a foot rest 24 as shown. Optimally, the elevation of the foot rest 24 is adjustable independent of the seat. 16's elevation. That way, a user U can set the seat 16's height to a comfortable work height depending on the height of the patient W (or more accurately the exam area of the patient) and/or in view of the height of the keyboard $T_2$ or other input/interface/control device. Then, assuming that the seat 16's height is too tall for the user U's feet to reach the floor, the user U can move the foot rest 24 up or down to suit personal comfort so that the user U's legs won't dangle uncomfortably without support. Adjustment of the elevation of the foot rest 24 is accomplished through a lever or pump 26 on the swivel stand 12 as indicated.

It is a predominant aspect of the invention that the inventive chair 10 is provided outrigged limb rests 50,150 for outstretched arms including as for example in the manners as shown by the drawings. In FIG. 1, the chair 10 is shown with alternative versions 50 and 150 of outrigged limb rests for outstretched arms. One version 50 is shown on the left side. An alternate version 150, including an optional embellishment 40 (indicated in, eg., FIG. 2) is shown on the right side. It should be understood that the drawings show these two examples 50 and 150 as non-exclusive means for accomplishing the aspects of the inventions, and the invention is not limited to the examples shown and described only. Accordingly, the inventive chair 10 can incorporate just one of the two shown versions 50 or 150, or two of one same shown version 50 or 150, or switch sides of the shown versions, or else substitute equivalent substitutes therefor and still be encompassed by the invention.

That aside, and referring to the left side outrigged limb rest 50 for an outstretched arm (ie., the orientation for "left" side being referenced to the left arm of the user U and/or the vantage point of the view), it comprises a "step" (eg., straightened Z) shaped assembly including an upright columnar mid-span 52 extending between a lower, inboard foot section 54 and an upper, outboard prop section 56. The upright columnar mid-span 52 is produced by mating sliding pieces 62 and 64 which allow relative height adjustment. That is, there is an upper inner sliding piece 64 which has a slot in it (not shown, but see FIG. 2). The lower piece 62 is a rectangular tube formed with a bolt hole (not in view) and wherein a bolt (also not in view) sticks through the bolt hole as well as the slot in the upper inner sliding piece (while none of this is in view, see FIG. 2). A locking thumbnut 66 tightens onto the bolt, pulling the opposite walls of the rectangular tube 62 to clamp onto the inner sliding piece 64. Slackening and tightening the thumbnut 66 allows a user U to lock the sliding pieces 62 and 64 at selective positions as desired. This accomplishes adjusting the elevation of the upper prop section 56 relative the seat 16. The lower, inboard foot section 54 mounts to the seat 16's rigid base for lateral adjustment between lateral inboard and outboard extremes. The lower, inboard foot section 54 has a slot in it (see, eg., FIG. 2) as the seat 16's rigid base has a threaded stud for insertion through the slot (this is not shown). Slackening and tightening the thumbnut 68 allows a user U to lock the sliding lower, inboard foot piece 54 at selective positions as desired. Preferably the seat 16's rigid base includes an inverted channel (not in view) to confine the sliding axis of the lower, inboard foot piece 54 to along a general inboard to outboard axis.

Figure 2:
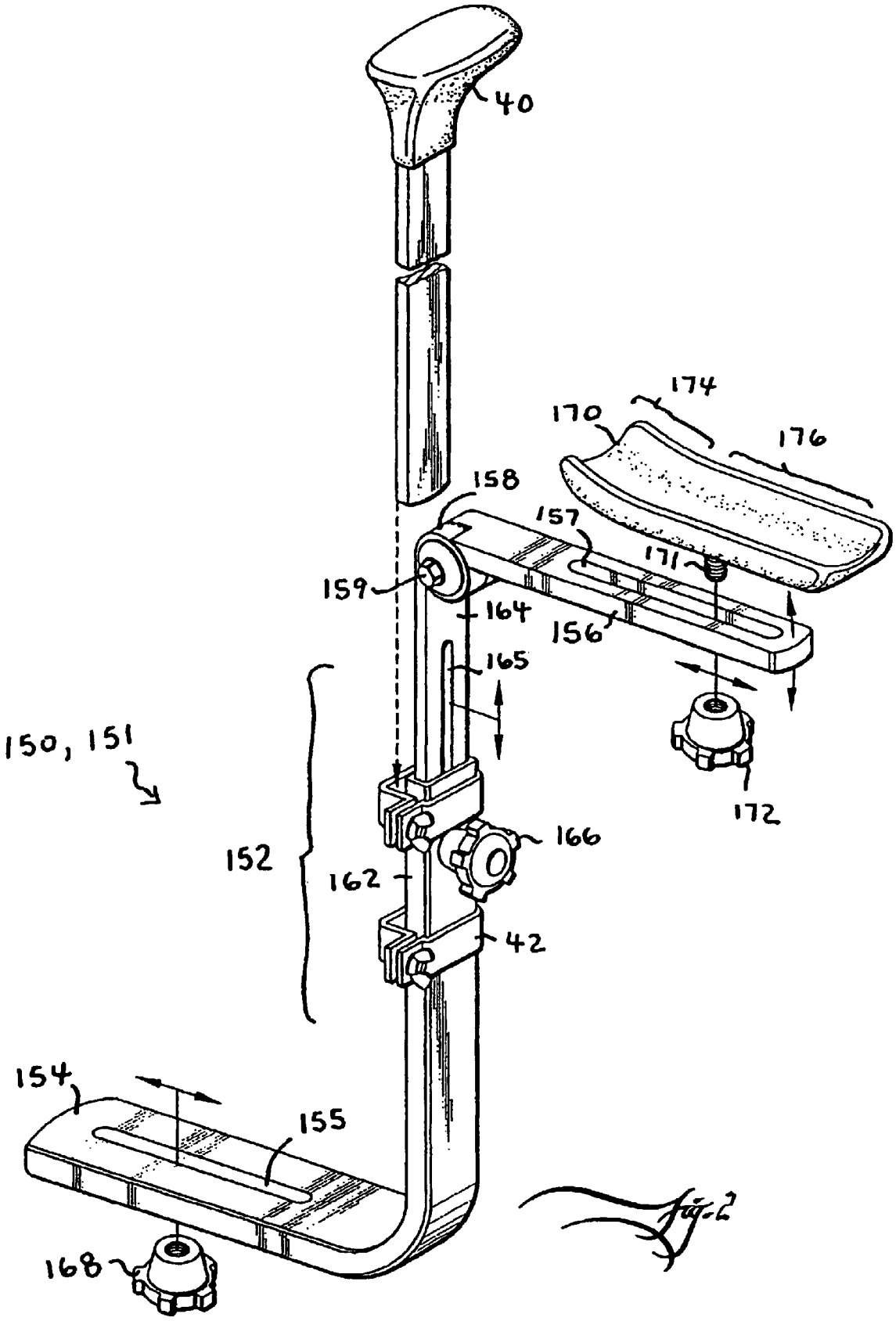
FIG. 2 is an enlarged scale perspective view of one example embodiment of an outrigged limb rest for outstretched arm in accordance with the invention the lift section in a deployed position, with portions of the bed broken away.

The upper, outboard prop section 56 carries a form of a limb rest 70 or, more preferably, such a limb rest 70 including an inboard cup section for elbow support as well as an outboard trough section for forearm support as shown better by FIG. 2. As more particularly explained below in connection with FIG. 2, the limb rest 70 is adjustable on the prop section 56 by a locking thumbnut 72 as incorporated elsewhere in both the columnar mid-span assembly 52 and the lower, inboard foot section 54. Slackening and tightening the thumbnut 72 allows a user U to lock the limb rest 70 at selected positions relative to the prop section 56 ranging between inboard and outboard extremes.

Also, the limb rest 70 can be locked in a slightly twisted or swivelled position because, in actual use, the user U's arms are not outstretched perfectly outward left and right but only predominantly so. In fact, it is more comfortable if the user U's arms are a little bit in front of him or her. Whereas the user U's elbows might be abducted up as shown and stationed substantially straight away to the left or right of the same-side shoulder socket, in contrast the user U's forearms might be bent in a slightly pincer position since that might be less straining to hold for long periods of time. To accommodate this, the limb rests 70,170 might be swivelled on their supporting props 56,156 to make this sort of pincer position more comfortable.

FIG. 1 also shows that the chair 10 includes a back rest 30 as shown. The back rest 30 is carried on top of an L-shaped support column 32 (the foot of the L-shape not in view) which has a slotted foot section (again not in view) for an adjustable mounting with the seat 16's rigid base as disclosed in connection with the left side (and/or right side) outrigged limb rest 50,150 for an outstretched arm. That is, the seat 16's rigid base has a threaded stud sticking down out of it which inserts through the slot of the slotted foot (this is not shown), allowing locking by tightening a thumbnut therefor (not in view). Accordingly, the back rest 30 can be adjusted between forward and rearward extremes relative the seat 16 by slackening and tightening the thumbnut therefor and moving the columnar support 32 to selected positions. What is accomplished is the following. The user U can set the forward to rearward position of the back rest 30 so that, depending on the back rest 30's position, the user U is either situated directly on the line drawn between the opposite outrigged limb rests 56 and 156, or slightly forward of or rearward of the line drawn between the opposite limb rests 56 and 156. That way a user U might have his or her upper arms not only abducted as shown but also swept slightly in front of him or her in further defining a pincer position with his or her upper arms too. Though the user U's pants seat (eg., butt) might be scooted back deeper in the chair seat 16, the outrigged limb rests 50,150 in combination with the back rest 30 are nevertheless multiply adjustable to find some comfortable position for the user U no matter what depth he or she chooses to sit in the seat 16.

To refer again to the left side outrigged limb rest 50 for an outstretched arm, FIG. 1 allows further discussion of the following matters. The user U is seated upright naturally enough, with spine generally erect and defining a median axis of the user U's torso, which generally coincides with a vertical line. The user U's left upper arm is abducted to about the 8:00 o'clock position (relative the vantage point of the view), or subtending about very approximately a 60° angle with the median axis of the spine which, eg., extends along an axis generally along the 12:00 o'clock to 6:00 o'clock line. The user U's forearm is thrust further outboard to reach the keyboard $T_2$ (or, eg., other input/interface/control device). Given the foregoing, it is an aspect of the invention the outrigged limb rest 50 (or 150) for outstretched arms is adjustable in various positions that sweep up and outboard away from the user U's hip to provide support for the abducted upper arm as shown.

To turn now to the matter of the right side outrigged limb rest 150 for an outstretched arm, it comprise a different version from the left side 50 and is better shown by FIG. 2. In FIG. 2, the right side outrigged limb rest 150 for an outstretched arm comprises an L-shaped columnar assembly 151 having a lower, inboard foot section 154 and a generally upright span 152 produced from telescoped sliding pieces 162 and 164. The lower, inboard foot section 154 has a central slot 155 for mounting the seat 16's rigid base. That is, the seat 16's rigid base has a threaded stud sticking down out of it (not shown). The threaded stud inserts into the slot 155. The thumbnut 168 tightens onto the stud and locks the lower, inboard foot section 154 in a selective positions relative the seat 16's rigid base (again, the seat 16, rigid base thereof and this particular stud are not in view in FIG. 2). Slackening and tightening the thumbnut 168 allows a user U to lock the L-shaped columnar assembly 151 in selective positions between inboard and outboard extremes relative to the seat 16.

The sliding pieces 162 and 164 comprise an upper inner sliding piece 164 and a lower outer rectangular tube 162. The inner sliding piece 164 has a slot 165 in it. The outer rectangular tube 162 has a hole in it (not in view) allowing insertion of a bolt (also not in view) both through the hole of the outer tube 162 as well as the slot 165 in the inner sliding piece 164. A thumbnut 166 tightens onto the bolt and clamps the opposite walls of the outer tube 162 onto the inner sliding piece 164 to lock the inner sliding piece 164 in selective positions. More particularly, slackening and tightening the thumbnut 166 allows a user U to lock in the inner sliding piece 164 in selective positions between upper and lower extremes of elevation relative to the seat 16. The inner sliding piece 164 terminates at its upper end in pivot or hinge connection 158 with an outboard prop section 156. The pivot connection 158 is locked by a lock bolt 159. Slackening and tightening the lock bolt 159 allows a user U to lock the prop section 156 in selective angles of vertical sweep between upper and lower extremes. Providing the mating halves of the pivot connection 156 with meshing face gears helps eliminate frictional slip of the locked prop section 156.

The prop section 156 is formed with a slot 157 extending between inner and outer extremes. The prop section 156 provides support for a form of limb rest 170 for an outstretched arm. The limb rest 170 has a threaded stud 171 sticking down out of its bottom. The threaded stud 171 inserts through the slot 157 in the prop piece 156 and a thumbnut 172 tightens the limb rest 170 in selective positions along that slot 157. In addition, the limb rest 170 can be tightened slightly twisted or swivelled relative the median axis of the prop section 156 to accommodate the user U's forearm(s) flexed in a slightly pincer position.

FIG. 2 shows the limb rest 170 (as does FIG. 1 in connection with limb rest 70) as a form having a relatively cup-shaped elbow portion 174 changing into a trough-shaped forearm portion 176. However, this form 170 (or 70) is shown merely for convenience of the description and the limb rest 170 (or 70) is not intended to be limited to the examples mentioned. Accordingly, the form of the limb rest(s) 70,170 can take on alternative configurations including a simple (padded) bar shape, or else a (padded) wedge shape. Indeed the form of the limb rest(s) 70,170 shown by the drawings can be locked down and tilted clockwise or counterclockwise from flush contact with the respective prop piece 56,156 by insertion of wedge-shaped shims (not shown). Preferably the limb rest(s) 56,156 is/are constructed similarly as the seat: ie., as produced with a rigid base covered over by an open-cell foam cushion.

The advantages of the pivoting prop piece 156 includes the following things. The prop piece 156 can be set in various use positions of varying vertical sweep extremes of say, very generally between 4:00 o'clock and 2:00 o'clock. Alternatively, the prop piece 156 might be dropped down to a non-use position simply to get it out of the way in cases where it is not wanted.

FIG. 2 shows an embellishment 40 which can be added to both the left side or right side versions 50 or 150 of the outrigged limb rests for outstretched arms. More particularly, an abbreviated crutch or rest 40 is affixed to the respective columnar support 162 by means of a pair of clamping rings 42. The clamping rings 42 are tightened and slackened by wingnuts to allow a user to lock the rest 40 in selective positions between upper and lower extremes and independently of the elevation setting for the prop piece 56,156. FIG. 1 shows the user U leaning onto the crutch or rest 40. Given FIG. 1, the user U has both his or her arms outstretched where the brunt of carrying the weight of his or her arms are borne by the forms of outrigged limb rests 70 and 170. In addition, the crutch or rest 40 affords the user U opportunity to lean thereon and prop up the weight of his or her shoulder girdle, which may lessen the fatigue of his or her posture muscles.

In brief, the foregoing chair 10 is designed predominantly with a worker U in mind who works in such a spread arm (or spread "wing") fashion for extended periods of time. Most notably such a worker U includes without limitation a sonographer. The chair 10 has inventive aspects which provide support to the user U's arms, shoulders, back and forearms during work. The chair 10 has ergonomic design aspects which help a user U work as correctly as possible as, say, a sonographer working to scan a target area on a patient W. The chair 10 reduces fatigue by allowing the user U to rest his or her arms on the outrigged limb rests 50 and/or 150 of the chair 10. This ought to curb the incidence of musculoskeletal injuries in such fields as sonography, which has been as high as 85%.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

We claim:

1. A chair having an outrigged limb rest for a seated working posture involving a laterally outstretched working arm, comprising:

a seat extending between flanking lateral margins and spaced frontal and back margins, at least one of said lateral margins serves as a working side;

a back rest disposed along the back margin; and an inboard rest structure disposed along the lateral margin of the working side, and comprising a given mounting structure supported by the chair at a lower portion and extending therefrom to an upper termination, in a crutch head, wherein either the given mounting structure or crutch head is adjustably supported by the chair, respectively, such that the crutch head can be moved between one of inboard and outboard extremes and one of upper and lower extremes in order that a seated occupant can adjust the crutch head under his or her armpit and thereby sag with all his or her weight on the crutch head and yet still be propped up in order to promote upright posture or alternatively dissuade posture that finds the seated occupant's spine leaning laterally over from a vertical axis; and an outrigged rest structure disposed along said same lateral margin and comprising an outrigger mounting structure and a limb rest supported thereby, said outrigged rest structure being adjustable to situate the limb rest in positions to support the occupant's working forearm while occupant's working upper arm is abducted to about the 4 to 3 o'clock position, or alternatively subtending about very approximately a 60° to 90° angle sweeping laterally up from straight down;

whereby the crutch head acts to block the seated occupant's torso from leaning out as the limb rest acts to block the outstretched elbow from falling in, as from tiredness from lengthy periods of work as with the working hand substantially outstretched laterally away from occupant's hip or shoulder.

2. The chair of claim 1 further comprising opposite inboard rest and outrigged rest structures disposed along another of the seat's lateral margins.

3. The chair of claim 1 wherein the limb rest is adjustable for relative tilt to accommodate working postures varying in range from the working hand of the seated occupant at an elevation relatively lower than the elbow of the seated occupant to relatively higher.

4. A chair having an outrigged limb rest for a seated working posture involving a laterally outstretched working arm, comprising:

a seat extending between flanking lateral margins and spaced front and back margins, at least one of said lateral margins serves as a working side;

a back rest disposed along the back margin; and an inboard rest structure disposed along the lateral margin of the working side, and comprising a given mounting structure supported by the chair at a lower portion and extending therefrom to an upper portion carrying a lean-against support, wherein either the given mounting structure or the lean-against support is adjustably supported by the chair, respectively, such that the lean-against support can be moved between inboard and outboard extremes as well as upper and lower extremes in order that a seated occupant can adjust and releasably fix the lean-against support to various positions for comfort to lean against with all his or her weight and yet still be supported in order to promote upright posture or alternatively dissuade posture that finds the seated occupant's spine leaning laterally over from a vertical axis; and an outrigged rest structure, disposed along the same lateral margin, and comprising an outrigger mounting structure supported by the chair at a proximal portion and extending therefrom to a distal portion carrying a prop support, wherein either the outrigger mounting structure or prop support is adjustably supported by the chair, respectively, such that the prop support can be moved between inboard and outboard extremes, including a spacing that is laterally and substantially out from the lean-against support, as well as upper and lower extremes so that the seated occupant can adjust and releasably fix the prop support to various positions for comfort to rest his or her working elbow and/or forearm upon to prevent such from falling in or down and thereby allow the shoulder muscles to relax rather than having to be persistently tensed in order to keep the working arm elevated out;

wherein the outrigged rest structure is structured to afford independent adjustment after the inboard rest structure has been releasably fixed so that adjustment of the prop support is available without having to loosen in consequence the releasably fixed lean-against support.

5. The chair of claim 4 further comprising opposite inboard rest and outrigged rest structures disposed along another of the seat's lateral margins.

6. The chair of claim 4 wherein the prop support is adjustable for relative tilt to accommodate working postures varying in range from the working hand of the seated occupant at an elevation relatively lower than the elbow of the seated occupant to relatively higher.

7. A chair having an outrigged limb rest for a seated working posture involving a laterally outstretched working arm, comprising:

a seat extending between flanking lateral margins and spaced front and back margins, at least one of said lateral margins serves as a working side;

a back rest disposed along the back margin; and an inboard rest structure disposed along the lateral margin of the working side, and comprising a given mounting structure supported by the chair at a lower portion and extending therefrom to an upper portion carrying a lean-against support, wherein either the given mounting structure or the lean-against support is adjustably supported by the chair, respectively, such that the lean-against support can be moved between inboard and outboard extremes as well as upper and lower extremes in order that a seated occupant can adjust and releasably fix the lean-against support to various positions for comfort to lean against with all his or her weight and yet still be supported in order to promote upright posture or alternatively dissuade posture that finds the seated occupant's spine leaning laterally over from a vertical axis; and an outboard rest structure, disposed along the same lateral margin, and comprising a chosen mounting structure supported by the chair at a proximal portion and extending therefrom to a distal portion carrying a prop support, wherein either the chosen mounting structure or prop support is adjustably supported by the chair, respectively, such that the prop support can be moved between inboard and outboard extremes, including a spacing that is laterally and substantially out from the lean-against support, as well as upper and lower extremes so that the seated occupant can adjust and releasably fix the prop support to various positions for comfort to rest his or her working elbow and/or forearm upon to prevent such from falling in or down and thereby allow the shoulder muscles to relax rather than having to be persistently tensed in order to keep the working arm elevated out;

wherein the outboard rest structure is structured to afford independent adjustment after the inboard rest structure has been releasably fixed so that adjustment of the prop support is available without having to loosen in consequence the releasably fixed lean-against support.

8. The chair of claim 7 further comprising opposite inboard rest and outrigged rest structures disposed along another of the seat's lateral margins.

9. The chair of claim 7 wherein the prop support is adjustable for relative tilt to accommodate working postures varying in range from the working hand of the seated occupant at an elevation relatively lower elbow of the seated occupant to relatively higher.

* * * * *